United States Patent [19]

Torbet

[11] 4,021,037

[45] May 3, 1977

[54] TENNIS PRACTICE MACHINE

[76] Inventor: Philip A. Torbet, 97 W. 41st St., San Mateo, Calif. 94403

[22] Filed: Apr. 3, 1975

[21] Appl. No.: 565,023

[52] U.S. Cl. ..... 273/30; 124/51 A; 124/56

[51] Int. Cl.[2] ..... A63B 39/00

[58] Field of Search ..... 273/30, 26 D, 29 A; 124/11 R, 41 R, 51 A, 57, 56

[56] References Cited

UNITED STATES PATENTS

| | | | |
|---|---|---|---|
| 2,508,461 | 5/1950 | Lemon | 273/30 |
| 2,574,408 | 11/1951 | Moe | 124/11 R |
| 3,662,729 | 5/1972 | Henderson | 124/11 R |
| 3,905,349 | 9/1975 | Nielsen | 124/11 R |
| 3,917,265 | 11/1975 | Schrier et al. | 273/30 |

*Primary Examiner*—Richard C. Pinkham
*Assistant Examiner*—T. Brown
*Attorney, Agent, or Firm*—Townsend and Townsend

[57] ABSTRACT

Apparatus for collecting a projectile such as a tennis ball and launching it through the air is disclosed. The apparatus includes a conduit having an upstream end adapted to receive the projectile and a downstream end at which the projectile is expelled. A transfer valve is interposed in the conduit and prevents passage of air through the transfer valve towards the upstream end of the conduit. Suction is provided to the conduit immediately upstream of the transfer valve and forced air is provided immediately downstream of the transfer valve. The projectile is sucked through the conduit from the upstream end thereof to the transfer valve. The transfer valve allows the projectile to pass, and the forced air forces the projectile through the remainder of the conduit so that it is expelled at the downstream end thereof. A ball restraining flange may be interposed in the conduit downstream of the transfer valve to restrain the projectile until the forced air builds up to a predetermined pressure so that the projectile is expelled at relatively high velocity.

12 Claims, 4 Drawing Figures

TENNIS PRACTICE MACHINE

BACKGROUND OF THE INVENTION

The present invention relates to apparatus for collecting a projectile such as a tennis ball and launching it through the air.

As the game of tennis becomes more and more popular, not only are more persons taking up the sport, but those engaged in the sport are trying to improve the quality of their game. Such improvement ordinarily entails practice, and it has been found that a useful adjunct to such practice is a machine which expels the tennis ball in a constant and repeatable fachion so that the player can practice one shot continuously. With such a machine the player can practice one particular shot until he has it mastered, and then proceed to practice other shots.

A variety of tennis ball practice machines are known in the prior art. Many of these machines operate basically on the principle illustrated in the patent to Horvath, U.S. Pat. No. 3,584,614. Such machines have a raised hopper into which a plurality of tennis balls can be inserted, and the tennis balls are gravity fed from the hopper to a pressurized air chamber which launches the balls individually. While this type of device does provide a usable practice machine, it only launches the tennis balls and is not capable of collecting them. The hopper must be raised above the ground so that the tennis balls can be gravity fed to the launching apparatus, and the machine is incapable of retrieving the balls at ground level. After the supply of tennis balls in the hopper is depleted, they must be picked up by the player and reinserted in the hopper in order for his practice to continue.

SUMMARY OF THE INVENTION

The present invention provides apparatus which collects a projectile such as a tennis ball at one level and launches the projectile through the air at a higher level. The apparatus includes a conduit having an upstream end adapted to receive the projectile and a downstream end at which the projectile is expelled. A transfer valve is interposed in the conduit and prevents passage of air through the transfer valve towards the upstream end of the conduit. Suction is provided to the conduit immediately upstream of the transfer valve and forced air is provided immediately downstream of the transfer valve. The projectile is sucked through the conduit from the upstream end thereof to the transfer valve. The transfer valve allows the projectile to pass, and the forced air forces the projectile through the remainder of the conduit so that it is expelled at the downstream end thereof. A ball restraining flange may be interposed in the conduit downstream of the transfer valve to restrain the projectile until the forced air builds up to a predetermined pressure so that the projectile is expelled at relatively high velocity.

In the preferred embodiment of the present invention, the tennis ball is collected at ground level and expelled at a higher level toward the practicing tennis player. A net is provided having a ramp which collects the tennis ball after the player has stroked it into the net. The upstream end of the conduit is located at the lower end of the ramp so that the tennis ball will roll down the ramp and be sucked into the conduit. The downstream end of the conduit can project through the net so that the ball is expelled back toward the player like a normal tennis stroke. A single tennis ball can thus be kept in action by the player, and each time that the player hits the ball into the net, the tennis ball is collected automatically and returned to him. The apparatus of the present invention avoids the necessity of having several balls which must be individually collected after they have been used and returned to a hopper, and the apparatus will operate continuously until the player wishes to discontinue practice.

The novel features which are believed to be characteristic of the invention, both as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
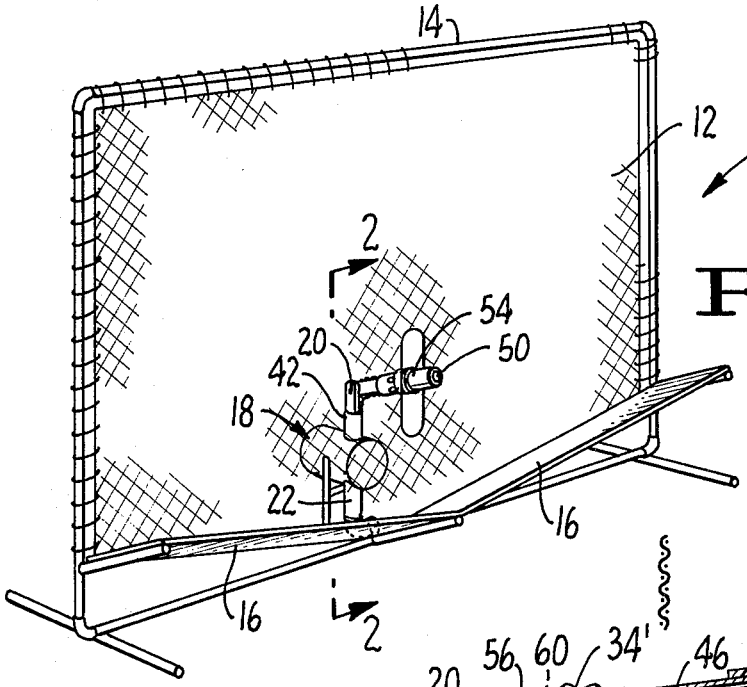
FIG. 1 is perspective view of a tennis practice machine embodying the present invention.

A tennis practice machine 10 constructed according to the teachings of the present invention as depicted in FIG. 1. The practice machine includes a net 12 mounted on frame 14 which is adapted to intercept the tennis ball after it has been hit by the player. After striking net 12, the tennis ball will fall onto a V-shaped ramp 16 at the lower end of the net. The ball rolls down ramp 16 to the center, at which point it is collected by ball return apparatus 18 and launched back toward the player, who again hits it into the net 12. The tennis ball is both collected and returned by ball return apparatus 18 so that a single tennis ball can be kept in continuous operation by the apparatus of the present invention to provide uninterrupted practice for the player. The angle at which the tennis ball is returned to the player can be varied at pivot 20 so that the player can practice a single shot until he has it mastered, and then can reset the apparatus by manipulating pivot 20 to practice a different type of shot.

Figure 2:
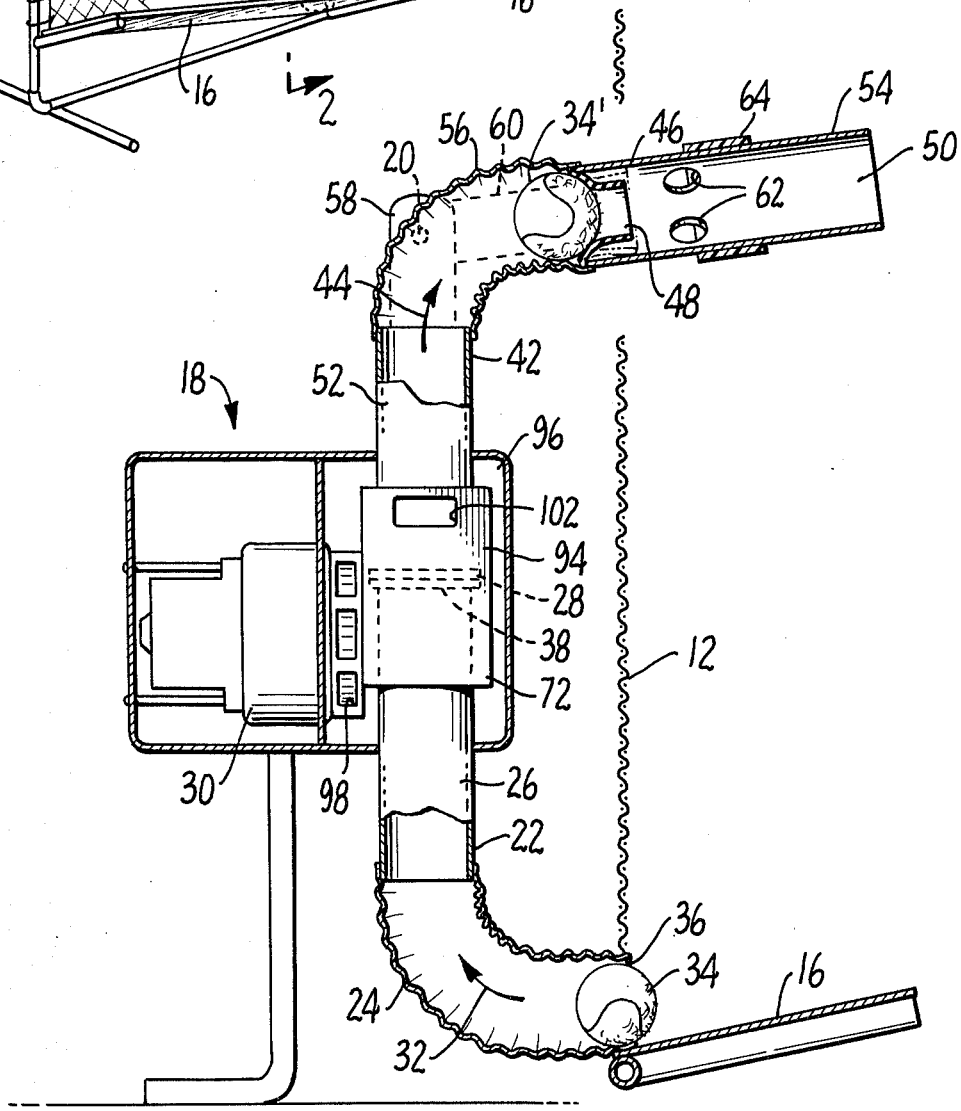
FIG. 2 is a sectional view taken along lines 2—2 of FIG. 1.

The structure of the ball return apparatus 18 of the present invention is illustrated in more detail by way of reference to FIG. 2. An intake tube 22 has a lower flexible section 24 which terminates at the base of the base of the V-shaped ramp 16, and an upper rigid portion 26 which terminates at a transfer valve 28. A blower 30 has its intake portion communicating with the upper end of intake tube 22, as described in more detail hereinafter. Transfer valve 28, also described in more detail hereinafter, prevents the flow of air downwardly into intake tube 22 so that the intake of blower 30 provides suction at the upper end of intake tube 22. Air is thus drawn through intake tube 22 from its upstream end 36 to downstream end 38 as depicted by arrow 32. As a result, when a tennis ball such as 34 rolls down ramp 16 to a position at upstream end 36 of intake tube 22, it will be drawn into and through the intake tube to the downstream end 38 thereof by the suction created by the intake of blower 30.

Transfer valve 28, as illustrated hereinbelow, allows the momentum of tennis ball 34 to carry it through the transfer valve. The output end of blower 30 communicates with exhaust tube 42 to provide forced air at the lower end of the exhaust tube. The forced air, depicted by arrow 44, will force the tennis ball through exhaust tube 42 until it contacts a restraining flange 46 constructed of resilient, deformable material. Restraining flange 46 has an inner aperture 48 whose diameter is less than that of the tennis ball. As a result, the tennis ball will not pass through restraining flange 46 until sufficient air pressure is built up in exhaust tube 42 to squeeze the tennis ball through the restraining flange. Once the tennis ball passes through restraining flange 46, it is expelled out of the downstream end 50 of exhaust tube 42.

As shown in FIG. 2, exhaust tube 42 includes a first rigid portion 52 and a second rigid portion 54 interconnected by a flexible portion 56. Pivotably interconnected members 58, 60 interconnect rigid portions 52, 54 so that the inclination of the second rigid portion 52 can be controlled to select the inclination at which the tennis ball is launched. Furthermore, a plurality of air escape holes 62 are provided in exhaust tube 42 downstream of restraining flange 46. Holes 62 can be partially covered by sleeve 64 to control the escape of air through the holes as the tennis ball is being launched through tube 42. Sleeve 64 can thus be moved to control the velocity at which the tennis ball is launched. Hence, the apparatus of the present invention allows for control over both the inclination and velocity of the tennis ball so that various shots can be practiced by a person using the machine.

Figure 4:
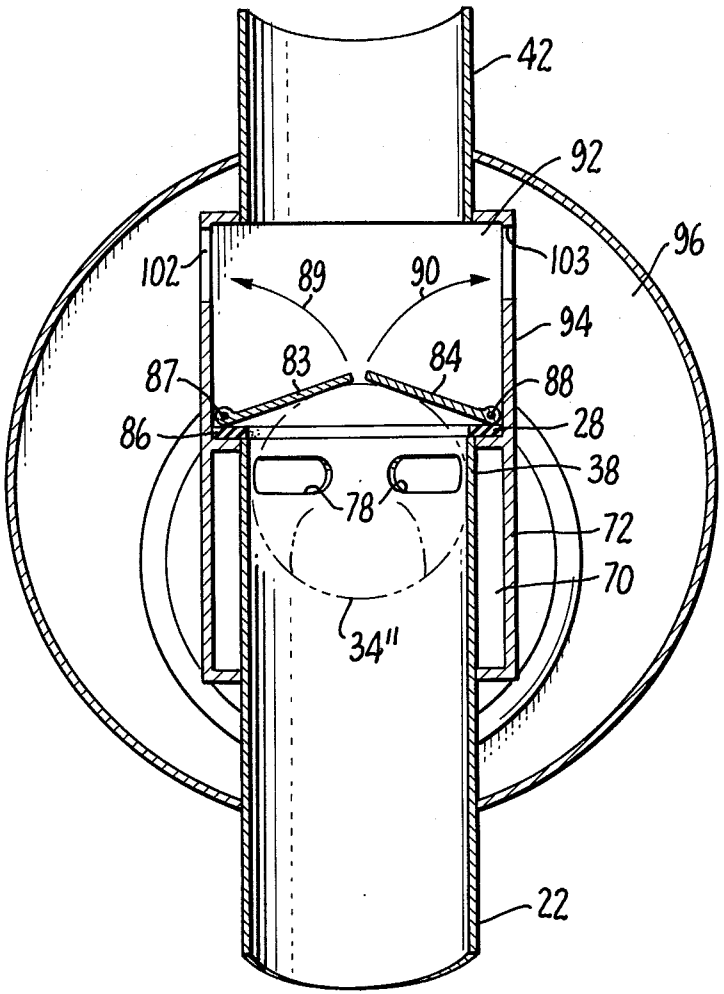
FIG. 4 is a sectional view taken along lines 4—4 of FIG. 3.
Figure 3:
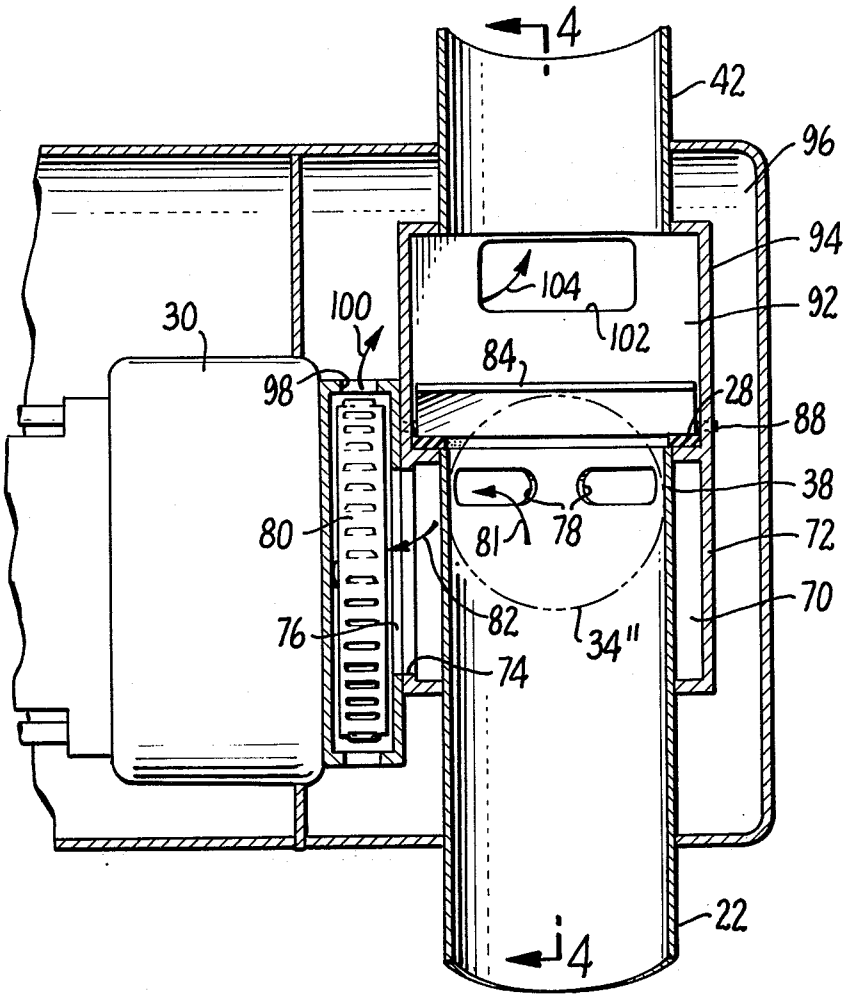
FIG. 3 is an expanded sectional view of the transfer valve portion of the apparatus of FIGS. 1 and 2.

The construction of the transfer valve 28 and related elements is illustrated in more detail by way of reference to FIGS. 3 and 4 in combination. A vacuum chamber 70 is formed around the downstream end 38 of intake tube 22 by a wall structure 72. An aperture 74 is provided in one side of wall structure 72 so that the intake portion 76 of blower 30 communicates with the interior of vacuum chamber 70. A plurality of apertures 78 are provided at the downstream 38 of intake tube 22 so that air is drawn from within the tube through the apertures and into the fan portion 80 of the blower, as illustrated by arrows 81, 82. As a result of this suction, the tennis ball, illustrated in phantom at 34'', is drawn to a position immediately beneath transfer valve 28.

Transfer valve 28 includes a pair of flapper valve sections 83, 84 pivotably connected to support structure 86 at 87, 88. Flapper valve sections 83, 84 are adapted to normally overlie the upstream end 38 of intake tube 22 so that air cannot normally pass into the upper end of the intake tube. However, when the tennis ball 34'' passing upwardly through the intake tube 22 contacts flapper valve sections 83, 84, the momentum of the tennis ball will cause the flapper valve sections to pivot out of the way of the tennis ball, as illustrated by way of arrows 89, 90, to allow the tennis ball to pass through the flapper valve.

A pressure chamber 92 defined by walled structure 94 is interposed between flapper valve 28 and exhaust tube 42. Pressure chamber 94 is in turn located within an enclosed plenum chamber 96. Forced air from the fan 80 of blower 30 passes through an aperture 98 and to plenum chamber 96 as illustrated by arrow 100. Apertures 102, 103 are provided in the wall structure 94 defining pressure chamber 92 so that the air in the plenum passes into exhaust tube 42, as illustrated by arrow 104. As discussed hereinabove, this forced air will force the tennis ball through exhaust tube 42 until it contacts the restraining flange, and when the pressure of the forced air is sufficient to force the tennis ball through the restraining flange, it will be launched back toward the player.

A player who wishes to initiate operation of the tennis practice machine 10 of the present invention first hits a tennis ball toward the apparatus so that it is intersected by net 12. After striking the net the ball will fall onto V-shaped ramp 16 and roll toward the center. When it reaches the center of the ramp, it will be sucked into inlet tube 22, pass through transfer valve 28 by its own momentum, and be forced against restraining flange 46 by the forced air from blower 30. When sufficient air pressure is built up to force the tennis ball through the restraining flange, it is returned to the tennis player, simulating a normal tennis stroke. Intake tube 22 and exhaust tube 42 provide a conduit from a lower collecting position to a higher launching position to simulate passage of the ball over a standard tennis net. Each time the ball is returned to the tennis practice machine by the player, it will be returned to him in a constant, repeatable fashion. If the tennis player wishes to change the manner in which the ball is launched toward him, he can change the angle of inclination at which it is launched at pivot 20, and the velocity can be modified by moving sleeve 64.

While a preferred embodiment of the present invention has been illustrated in detail, it is apparent that modifications and adaptations of that embodiment will occur to those skilled in the art. For example, it is possible that the collection and return apparatus could be used in various applications other than as a tennis practice machine. However, it is to be expressly understood that such modifications and adaptations are within the spirit and scope of the present invention, as set forth in the following claims.

What I claim as new is:

1. Apparatus for collecting a projectile such as a tennis ball and launching it through the air, said apparatus comprising:

a conduit having an upstream end adapted to receive the projectile and an opposite downstream end adapted to expel the projectile;

a passive transfer valve interposed in the conduit intermediate its ends and adapted to normally prevent the passage of air through the transfer valve toward the upstream end of the conduit, said transfer valve being opened by the impact of the projectile passing through the transfer valve toward the downstream end of the conduit, said transfer valve adapted to close after passage of the projectile therethrough; and air flow means including means for providing suction to the conduit immediately upstream of the transfer valve and means for providing forced air to the conduit immediately downstream of the transfer valve so that the projectile is sucked through the conduit from the upstream end thereof to a position immediately upstream of the transfer valve, the momentum of the projectile carries the projectile through the transfer valve, and the forced air forces the projectile through the remainder of the conduit to expel the projectile at the downstream end thereof.

2. Apparatus as recited in claim 1 and additionally comprising a deformable restraining flange interposed in the conduit downstream of the transfer valve, said restraining flange having a circular interior aperture having a diameter less than the diameter of the projectile so that the projectile is trapped by the flange until the forced air pressure is sufficient to force the projectile through the restraining flange.

3. Apparatus as recited in claim 1 wherein the passive valve comprises a flapper valve having two flapper sections spanning respective halves of the conduit, said flapper sections adapted to pivot toward the downstream end of the conduit upon contact of the projectile therewith.

4. Apparatus for collecting a projectile such as a tennis ball and launching it through the air, said apparatus comprising:

an intake tube adapted to receive the projectile at one end and expel the projectile at the other end, said intake tube having air intake ports at said other end thereof;

a vacuum chamber enclosing the outer circumference of said other end of the intake tube and communicating with the air intake ports;

a passive transfer valve attached to said other end of the intake tube and adapted to normally prevent the flow of air through the transfer valve and into the intake tube, said transfer valve being opened by the impact of the projectile from the intake tube passing through the transfer valve, said transfer valve adapted to close after passage of the projectile therethrough;

an exhaust tube having one end communicating with the transfer valve, said one end of the exhaust tube being generally coaxial with said other end of the intake tube so as to receive the projectile passing therethrough, said projectile adapted to be expelled from the other end of said exhaust tube; and means for providing forced air at said one end of the exhaust tube so that the projectile passes through the intake tube by suction, the momentum of the projectile carries it through the transfer valve and the projectile is forced at least partially through the exhaust tube in a continuous motion.

5. Apparatus as recited in claim 4 wherein the forced air means includes a pressure chamber interposed between the transfer valve and said one end of the exhaust tube.

6. Apparatus as recited in claim 4 and additionally comprising a restraining flange interposed in the exhaust tube and having a circular interior aperture with a diameter less than the diameter of the projectile so that the projectile is trapped by the flange until the forced air pressure is sufficient to force the projectile through the restraining flange.

7. Apparatus as recited in claim 4 wherein the passive transfer valve comprises a flapper valve having two flapper section spanning respective halves of the conduit, said flapper sections adapted to pivot toward the downstream end of the conduit upon contact of the projectile therewith.

8. Apparatus for collecting a tennis ball and launching it at a predetermined velocity, said apparatus comprising:

an intake tube adapted to receive the tennis ball at one end and expel the tennis ball at the other end, said intake tube having a plurality of air intake ports at said other end;

a vacuum chamber enclosing the outer circumference of said other end of the intake tube and communicating with the air intake ports;

a passive transfer valve attached to said other end of the intake tube and adapted to normally prevent the flow of air through the transfer valve and into the intake tube, said transfer valve being opened by the impact of the tennis ball from the intake tube passing through the transfer valve, said transfer valve adapted to close after passage of the projectile therethrough;

a pressure chamber connected to the transfer valve and adapted to receive the tennis ball passing through said transfer valve;

an exhaust tube having one end communicating with the pressure chamber to receive the tennis ball therefrom and expell the tennis ball from the other end of the exhaust tube;

a blower having an intake communicating with the vacuum chamber to provide suction thereto, and an exhaust communicating with the pressure chamber to provide forced air thereto; and a ball restraining flange interposed in the exhaust tube downstream of the pressure chamber, said restraining flange including a circular interior aperture having a diameter normally less than the diameter of a standard tennis ball so that the tennis ball is trapped by the flange until the forced air pressure is sufficient to force the projectile through the restraining flange.

9. A tennis practice system comprising:

a generally vertical net;

a generally V-shaped return ramp located at the lower extremity of the net so that a tennis ball impacting the net falls onto the return ramp and rolls down the ramp to the base of said ramp;

a conduit having an upstream end located at the base of the return ramp and adapted to receive the tennis ball therefrom and an opposite downstream end located relatively above the upstream end and adapted to expel the tennis ball;

a passive transfer valve interposed in the conduit intermediate its ends and adapted to normally prevent the passage of air through the transfer valve means toward the upstream end of the conduit, said transfer valve being opened by the impact of the tennis ball to allow passage of the tennis ball through the transfer valve toward the downstream end of the conduit, said transfer valve adapted to close after passage of the tennis ball therethrough; and air flow means including means for providing suction to the conduit immediately upstream of the transfer valve and means for providing forced air to the conduit immediately downstream of the transfer valve so that a single tennis ball can continuously be hit into the net collected and expelled by the conduit, and returned to the player without reloading.

10. Apparatus for collecting a projectile such as a tennis ball and launching it through the air, said apparatus comprising:

a conduit having an upstream end adapted to receive the projectile and an opposite downstream adapted to expel the projectile;

a flapper valve interposed in the conduit intermediate its ends and having two flapper sections spanning respective halves of the conduit, said flapper sections adapted to pivot toward the downstream end of the conduit so that the flapper valve is opened by the impact of the projectile passing through the flapper valve toward the downstream end of the conduit, said flapper sections adapted to close after passage of the projectile through the flapper valve; and air flow means including means for providing suction to the conduit immediately upstream of the flapper valve and means for providing forced air to the conduit immediately downstream of the flapper valve so that the projectile is sucked through the conduit from the upstream end thereof to a position immediately upstream of the flapper valve, the momentum of the projectile carries the projectile through the flapper valve, and the forced air forces the projectile through the remainder of the conduit to expel the projectile at the downstream end thereof.

11. Apparatus as recited in claim 10 wherein the upstream end of the conduit is located at a first position, and the downstream end of the conduit is located at a second position relatively higher than the upstream end so that the projectile is lifted from a first lower position to a second higher position as well as being expelled from the conduit.

12. Apparatus as recited in claim 10 and additionally comprising a deformable restraining flange interposed in the tube downstream of the transfer valve, said restraining flange having a circular interior aperture having a diameter less than the diameter of the projectile so that the projectile is trapped by the flange until the forced air pressure is sufficient to force the projectile through the restraining flange.

* * * * *